US009200357B2

(12) United States Patent
Tsuchida et al.

(10) Patent No.: US 9,200,357 B2
(45) Date of Patent: Dec. 1, 2015

(54) STEEL FOR MACHINE STRUCTURAL USE, MANUFACTURING METHOD FOR SAME, CASE HARDENED STEEL COMPONENT, AND MANUFACTURING METHOD FOR SAME

(75) Inventors: Takehiro Tsuchida, Kobe (JP); Tomokazu Masuda, Kobe (JP); Mutsuhisa Nagahama, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 280 days.

(21) Appl. No.: 13/395,696

(22) PCT Filed: Sep. 30, 2010

(86) PCT No.: PCT/JP2010/067185

§ 371 (c)(1),
(2), (4) Date: Mar. 13, 2012

(87) PCT Pub. No.: WO2011/040587

PCT Pub. Date: Apr. 7, 2011

(65) Prior Publication Data

US 2012/0168035 A1 Jul. 5, 2012

(30) Foreign Application Priority Data

Oct. 2, 2009 (JP) ..... 2009-230910
Oct. 2, 2009 (JP) ..... 2009-230911

(51) Int. Cl.
*C22C 38/02* (2006.01)
*C22C 38/06* (2006.01)
(Continued)

(52) U.S. Cl.
CPC ... *C23C 8/22* (2013.01); *C21D 1/06* (2013.01); *C21D 6/005* (2013.01); *C21D 6/008* (2013.01);
(Continued)

(58) Field of Classification Search
CPC ..... C22C 38/04; C22C 38/06; C22C 38/001; C22C 38/02; C22C 38/32
USPC ..... 148/318, 328, 319
See application file for complete search history.

(56) References Cited

U.S. PATENT DOCUMENTS 4,379,482 A * 4/1983 Suzuki et al. ..... 164/485
8,192,565 B2 * 6/2012 Masuda et al. ..... 148/622
(Continued)

FOREIGN PATENT DOCUMENTS

EP 0 637 636 A1 2/1995
JP 5-255803 10/1993
(Continued)

OTHER PUBLICATIONS

Machine translation of JP 09217143 A, Aug. 1997.*
(Continued)

*Primary Examiner* — Jie Yang
*Assistant Examiner* — Xiaowei Su
(74) *Attorney, Agent, or Firm* — Oblon, mcClelland, Maier & Neustadt, L.L.P.

(57) ABSTRACT

Disclosed is a steel for machine structural use including 0.05-0.8% of C, 0.03-2% of Si, 0.2-1.8% of Mn, 0.1-0.5% of Al, 0.0005-0.008% of B, and 0.002-0.015% of N, and including 0.03% of P or less (excluding 0%), 0.03% of S or less (excluding 0%), and 0.002% of O or less (excluding 0%), with the remainder comprising iron and unavoidable impurities. The ratio of BN/AlN precipitated in the steel is 0.020-0.2. Also disclosed is a case hardened steel component in which the ratio of BN/AlN deposited on the carburized or carbonitrided component surface is 0.01 or less and a manufacturing method for same. The steel for machine structural use exhibits excellent machinability in continuous cutting at high speeds using cemented carbide tools, and in interrupted cutting at low speeds using high-speed steel tools, as well as excellent impact performance, even after being subjected to a heat treatment such as quenching and tempering. Furthermore, the case hardened steel component exhibits excellent fatigue resistance, and particularly excellent pitting resistance.

3 Claims, 1 Drawing Sheet

(51) Int. Cl.

| | |
|---|---|
| ***C22C 38/20*** | (2006.01) |
| ***C22C 38/12*** | (2006.01) |
| ***C22C 38/14*** | (2006.01) |
| ***C22C 38/16*** | (2006.01) |
| ***C22C 38/04*** | (2006.01) |
| ***C22C 38/08*** | (2006.01) |
| ***C23C 8/22*** | (2006.01) |
| ***C21D 1/06*** | (2006.01) |
| ***C21D 6/00*** | (2006.01) |
| ***C21D 8/02*** | (2006.01) |
| ***C21D 8/06*** | (2006.01) |
| ***C21D 9/30*** | (2006.01) |
| ***C21D 9/32*** | (2006.01) |
| ***C22C 38/22*** | (2006.01) |
| ***C22C 38/32*** | (2006.01) |
| ***C23C 8/30*** | (2006.01) |
| ***C23C 8/80*** | (2006.01) |
| ***C22C 38/00*** | (2006.01) |
| ***C22C 38/24*** | (2006.01) |
| ***C22C 38/26*** | (2006.01) |
| ***C22C 38/28*** | (2006.01) |
| ***C22C 38/50*** | (2006.01) |
| ***C22C 38/54*** | (2006.01) |

(52) U.S. Cl.

CPC ..... *C21D 8/0205* (2013.01); *C21D 8/06* (2013.01); *C21D 9/30* (2013.01); *C21D 9/32* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/50* (2013.01); *C22C 38/54* (2013.01); *C23C 8/30* (2013.01); *C23C 8/80* (2013.01); *C21D 2211/001* (2013.01); *C21D 2211/004* (2013.01)

(56) References Cited

U.S. PATENT DOCUMENTS

| | | | | |
|---|---|---|---|---|
| 2009/0274573 | A1 * | 11/2009 | Miyanishi et al. | 420/84 |
| 2010/0193090 | A1 | 8/2010 | Masuda et al. | |
| 2012/0063945 | A1 * | 3/2012 | Tsuchida et al. | 420/93 |

FOREIGN PATENT DOCUMENTS

| | | | |
|---|---|---|---|
| JP | 06057369 | A * | 3/1994 |
| JP | 7-41851 | | 2/1995 |
| JP | 7 238314 | | 9/1995 |
| JP | 7 238343 | | 9/1995 |
| JP | 09217143 | A * | 8/1997 |
| JP | 2001-192731 | | 7/2001 |
| JP | 2001 342539 | | 12/2001 |
| JP | 2002-180185 | | 6/2002 |
| JP | 2003 342635 | | 12/2003 |
| JP | 2004-307902 | | 11/2004 |
| JP | 2005 240175 | | 9/2005 |
| JP | 2008 13788 | | 1/2008 |
| JP | 2009 30160 | | 2/2009 |
| WO | WO 02/48417 | A1 | 6/2002 |
| WO | WO 03/042420 | A1 | 5/2003 |
| WO | WO 2008084749 | A1 * | 7/2008 |
| WO | WO 2009/104805 | A1 | 8/2009 |

OTHER PUBLICATIONS

Machine translation of JP 06057369 A, Mar. 1994.*

International Search Report Issued Dec. 21, 2010 in PCT/JP10/67185 Filed Sep. 30, 2010.

Supplementary Partial European Search Report issued Aug. 4, 2015, European Patent Application No. 10820702.8, filed Sep. 30, 2010.

* cited by examiner

STEEL FOR MACHINE STRUCTURAL USE, MANUFACTURING METHOD FOR SAME, CASE HARDENED STEEL COMPONENT, AND MANUFACTURING METHOD FOR SAME

TECHNICAL FIELD

The present invention relates to a steel for machine structural use for manufacturing machine structural components by cutting work, a manufacturing method for the same, a case hardened steel component obtained by cutting into a shape of the component and thereafter being carburized or carbonitrided, and a manufacturing method for the same.

BACKGROUND ART

In general, the machine structural components such as gears, shafts, pulleys, constant velocity universal joints and the like used for a variety of gear transmission devices to begin with a transmission and a differential gear for an automobile, as well as crank shafts, con'rods and the like are obtained by subjecting a steel for machine structural use to forging and the like and thereafter being finished into the final shape (the shape of the component) by cutting work. Because the cost required for the cutting work occupies a large portion in the total manufacturing cost, the steel for machine structural use is required to be excellent in machinability.

Also, it is desired that the machine structural component is excellent in fatigue property (particularly in pitting resistance). Therefore, the machine structural component is manufactured by finishing to the final shape (the shape of the component) by cutting work, and being subjected thereafter to a surface hardening treatment such as a carburizing treatment, a carobonitriding treatment and the like (including in the atmospheric pressure, low pressure, vacuum, and plasma atmosphere) in order to improve the fatigue property.

In cutting work for manufacturing a gear in particular out of the machine structural components, it is common to perform gear cutting by a hob, and cutting in the case is called interrupted cutting. As a tool used for bobbing, high speed tool steels coated with AlTiN and the like (may be hereinafter abbreviated as a "high-speed tool") are most popular at present. However, gear cutting by hobbing (interrupted cutting) using a high-speed tool is performed at a low speed (approximately 150 m/min or below cutting speed specifically) and at a low temperature (approximately 200-600° C. specifically), but the tool is likely to be brought in contact with the air because of the interrupted cutting, and there is a harmful effect that the tool becomes liable to be oxidized and worn. Therefore, in the steel for machine structural use used for low speed interrupted cutting such as hobbing and the like, it is required to extend the tool life in particular out of the machinability.

As a technology improving interrupted cutting property, in the patent literature 1, a steel for interrupted high speed cutting containing Al: 0.04-0.20%, O: 0.0030% or less is proposed. According to the technology, by subjecting the steel with increased Al content to interrupted cutting at a high speed, Al oxide is adhered on the tool surface, and thereby the tool life is improved. However, in the steel for interrupted high speed cutting, high speed interrupted cutting with 200 m/min or above cutting speed is usually in mind, and low speed interrupted cutting such as hobbing is not intended.

On the other hand, as a tool used for cutting work, in addition to the high-speed tool, there is also a tool subjecting cemented carbide to coating of AlTiN and the like (may be hereinafter abbreviated as a "cemented carbide tool"). Because of the problem that "chipping" is liable to occur when applied to a normalized material, the cemented carbide tool is usually applied to continuous cutting such as lathe cutting and the like. The continuous cutting such as lathe cutting and the like is normally performed at a cutting speed exceeding 150 m/min, and is performed at a high speed of 200 m/min or above in many cases.

Thus, the cutting mechanism is different between the interrupted cutting and continuous cutting, and a tool matching each cutting is selected. However, it is demanded that the steel for machine structural use as a material to be machined exerts excellent machinability in both types of cutting.

In the meantime, after being finished into the final shape, the steel for machine structural use is subjected to a surface hardening treatment such as a carburizing treatment, a carobonitriding treatment and the like (including in the atmospheric pressure, low pressure, vacuum, and plasma atmosphere), is further subjected to the heat treatments such as quenching and tempering as well as induction hardening and the like, and is strengthened to a predetermined strength. However, when it is subjected to a thermal effect, the toughness may drop and the impact performance may deteriorate.

As a technology improving the impact performance, in the patent literature 2, a steel for machine structural use containing Al in a range exceeding 0.1% and 0.3% or below is proposed. In the document, it is disclosed that the machinability and the impact performance can be improved by reducing the solid-resolved N amount, and that the cutting performance effective in a wide cutting speed range from a low speed to a high speed can be obtained by securing a proper amount of solid-resolved Al and AlN effective in improving the machinability by optimizing the Al content. According to the document, the impact performance of the steel for machine structural use is evaluated by measuring absorbed energy by the Charpy impact test. However, the absorbed energy achieved in the document does not reach 50 $J/cm^2$, and further improvement of the impact performance is required.

In the patent literature 3, the present applicant also proposed a steel for machine structural use exerting excellent machinability in both of interrupted cutting by a high speed tool and continuous cutting by a cemented carbide tool and exhibiting excellent impact performance even when it is subjected to carburizing-oil quenching and thereafter is subjected to a tempering treatment. According to the technology, the machinability and the impact performance are improved by properly controlling the contents of Cr and Al as well as the ratio of the contents thereof.

Also, as described above, it is also desirable that the machine structural components subjected to a surface hardening treatment such as a carburizing treatment, a carobonitriding treatment and the like after finished into a final shape are excellent in fatigue property (pitting resistance in particular).

As a technology providing a case hardened steel subjected to a surface hardening treatment, the patent literature 4 is known. According to the technology, the precipitation amount of AlN after hot rolling is limited to 0.01% or below, and, in order to prevent coarsening of the grains in carburizing, AlN and NbN are not utilized as the pinning particles, but Ti-based precipitates mainly of TiC and TiCS are utilized. Also, in order to improve the fatigue property (rolling fatigue property in the document), the maximum size of the Ti precipitates is made small. However, according to the technology, the Al content is stipulated in a range of a small amount of 0.005-0.05%, and it is not the technology improving the fatigue property of the case hardened components containing Al in a range of 0.1% or above.

DOCUMENT ON PRIOR ART

Patent Literature

[Patent literature 1] Japanese Unexamined Patent Application Publication No. 2001-342539

[Patent literature 2] Japanese Unexamined Patent Application Publication No. 2008-13788

[Patent literature 3] Japanese Unexamined Patent Application Publication No. 2009-30160

[Patent literature 4] Japanese Unexamined Patent Application Publication No. 2005-240175

SUMMARY OF THE INVENTION

Problems to be Solved by the Invention

The first object of the present invention is to provide a steel for machine structural use exerting excellent machinability (extending the tool life in particular) in interrupted cutting (hobbing for example) at a low speed using a high-speed tool, exerting excellent machinability (extending the tool life in particular) in continuous cutting (lathe cutting for example) also at a high speed using a cemented carbide tool, and exhibiting excellent impact performance even after being subjected to a heat treatment such as quenching and tempering and the like in a method different from that shown in the patent literature 3 proposed previously by the present applicant, and a manufacturing method for the same.

Also, the second object of the present invention is to provide a case hardened steel component which is a case hardened steel product obtained by being subjected to carburizing or carbonitriding and excellent in fatigue property (pitting resistance in particular), and a manufacturing method for the same.

Means for Solving the Problem

A steel for machine structural use in relation with the present invention that could solve the problems is a steel containing C: 0.05-0.8% (means mass %, hereinafter the same), Si: 0.03-2%, Mn: 0.2-1.8%, Al: 0.1-0.5%, B: 0.0005-0.008%, and N: 0.002-0.015%, and satisfying P: 0.03% or less (excluding 0%), S: 0.03% or less (excluding 0%), and O: 0.002% or less (excluding 0%), with the remainder including iron and unavoidable impurities, in which a mass ratio of BN and MN (BN/AlN) precipitated in the steel is 0.020-0.2.

It is preferable that, with respect to BN precipitated in the steel, the number ratio of BN precipitated on old austenitic grain boundaries and BN precipitated inside old austenitic grains (grain boundary BN/intra-grain BN) is 0.50 or less.

The steel for machine structural use may further contain as other elements:

(a) Cr: 3% or less (excluding 0%),
(b) Mo: 1% or less (excluding 0%),
(c) Nb: 0.15% or less (excluding 0%),
(d) at least one element selected from a group consisting of Zr: 0.02% or less (excluding 0%), Hf: 0.02% or less (excluding 0%), Ta: 0.02% or less (excluding 0%), and Ti: 0.02% or less (excluding 0%),
(e) at least one element selected from a group consisting of V: 0.5% or less (excluding 0%), Cu: 3% or less (excluding 0%), and Ni: 3% or less (excluding 0%), and the like.

A steel for machine structural use in relation with the present invention can be manufactured by a manufacturing method including a heating step of heating steel satisfying the componential composition to 1,100° C. or above, a holding step of holding the steel for 150 seconds or more at a temperature range of 900-1,050° C. after the heating step, and a cooling step of cooling the steel at an average cooling rate of 0.05-10° C./sec. from 900° C. to 700° C. after the holding step. Also, a hot working step of performing hot working at 1,000° C. or above may be executed after the heating step, and the total of the working time for the hot working step and the time for holding in the holding step may be made 150 seconds or more.

A case hardened steel component that could solve the problems is a case hardened steel component obtained by carburizing or carbonitriding a steel containing C: 0.05-0.8%, Si: 0.03-2%, Mn: 0.2-1.8%, Al: 0.1-0.5%, B: 0.0005-0.008%, and N: 0.002-0.015%, and satisfying P: 0.03% or less (excluding 0%), S: 0.03% or less (excluding 0%), and O: 0.002% or less (excluding 0%), with the remainder including iron and unavoidable impurities, in which a mass ratio of BN and AlN (BN/AlN) precipitated on the surface of the component is 0.01 or less (excluding 0).

The case hardened steel component may further contain as other elements:

(a) Cr: 3% or less (excluding 0%),
(b) Mo: 1% or less (excluding 0%),
(c) Nb: 0.15% or less (excluding 0%),
(d) at least one element selected from a group consisting of Zr: 0.02% or less (excluding 0%), Hf: 0.02% or less (excluding 0%), Ta: 0.02% or less (excluding 0%), and Ti: 0.02% or less (excluding 0%),
(e) at least one element selected from a group consisting of V: 0.5% or less (excluding 0%), Cu: 3% or less (excluding 0%), and Ni: 3% or less (excluding 0%), and the like.

The case hardened steel component in relation with the present invention can be manufactured by a manufacturing method including a cutting step of cutting a steel satisfying the componential composition into the shape of the component, a surface working step of subjecting a component subjected to the cutting work to a carburizing treatment or a carobonitriding treatment, and a cooling step of cooling the component after the step of the carburizing treatment or the carobonitriding treatment, in which the component is cooled at an average cooling rate of 0.10° C./sec. or less (excluding 0° C./sec.) from 900° C. to 800° C. in the cooling step.

In manufacturing the case hardened steel component, it is preferable to use the steel for machine structural use of the present invention described above. That is, when the steel for machine structural use of the present invention whose machinability (tool life in particular) in the cutting work into the shape of the component is improved is used, the case hardened steel component of the present invention can be manufactured more efficiently.

More specifically, prior to the cutting step, a heating step of heating a steel satisfying the componential composition to 1,100° C. or above, a holding step of holding the steel for 150 seconds or more at a temperature range of 900-1,050° C. after the heating step, and a cooling step of cooling the steel at an average cooling rate of 0.05-10° C./s from 900° C. to 700° C. after the holding step are performed.

Effects of the Invention

According to the steel for machine structural use of the present invention, because BN is positively precipitated while suppressing precipitation of AlN and the mass ratio of BN and AlN (BN/AlN) precipitated in the steel is adjusted to a proper range, a steel for machine structural use exerting excellent machinability (extending the tool life in particular) in both of interrupted cutting at a low speed and in continuous cutting at a high speed and exhibiting excellent impact property even after being subjected to a heat treatment and a manufacturing method for the same can be provided.

According to the case hardened steel component of the present invention, because the condition of the carburizing treatment or the carbonitriding treatment is properly controlled and the mass ratio of BN and MN (BN/AlN) precipitated on the surface of the component is suppressed to 0.01 or less, the case hardened steel component excellent in fatigue property (pitting resistance in particular) can be provided.

BEST MODE FOR CARRYING OUT THE INVENTION

Figure 1A:
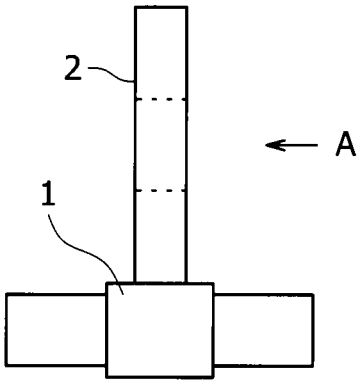
FIG. 1 is an explanatory drawing showing a state of a specimen in performing a Komatsu type roller pitting test, (A) is an overall view, and (B) is a drawing when viewed from the arrow A direction of (A).

First, the steel for machine structural use of the present invention will be described.

The present inventors have repeatedly done research from various aspects in order to provide a steel for machine structural use exerting excellent machinability (extending the tool life in particular) in both of interrupted cutting at a low speed and in continuous cutting at a high speed and exhibiting excellent impact property even after being subjected to a heat treatment such as quenching and tempering and the like. As a result, it was found out that, when the mass ratio of BN and AlN (BN/AlN) precipitated in the steel was controlled properly while properly adjusting the chemical componential composition of the steel for machine structural use, excellent machinability could be exhibited in both of interrupted cutting and continuous cutting and impact property after the heat treatment could also be improved, and the present invention was completed.

The chemical componential composition of the steel for machine structural use in relation with the present invention will be described, and thereafter the mass ratio of BN and AlN featuring the present invention will be described.

The steel for machine structural use of the present invention is to contain C: 0.05-0.8%, Si: 0.03-2%, Mn: 0.2-1.8%, Al: 0.1-0.5%, B: 0.0005-0.008%, and N: 0.002-0.015%, and to satisfy P: 0.03% or less (excluding 0%), S: 0.03% or less (excluding 0%), and O: 0.002% or less (excluding 0%). The reason of stipulating such a range is as described below.

C is a necessary element for securing the strength, and should be contained by 0.05% or more, preferably 0.1% or more, and more preferably 0.15% or more. However when the C content becomes excessive, the hardness increases excessively and the machinability and toughness drops. Accordingly, the C amount should be 0.8% or less, preferably 0.6% or less, and more preferably 0.5% or less.

Si is an element acting as a deoxidizing element and improving the internal quality, and should be contained by 0.03% or more, preferably 0.1% or more, and more preferably 0.15% or more. However, when the Si content becomes excessive, the hot workability and cold workability in working into the shape of the component may deteriorate, and an abnormal structure such as oxidation of the grain boundaries may be formed during the carburizing treatment or during the carbonitriding treatment performed after the cutting work into the shape of the component. Accordingly, the Si amount should be 2% or less, preferably 1.5% or less, more preferably 1% or less, and further more preferably 0.6% or less.

Mn is an element improving the quenchability and enhancing the strength, and should be contained by 0.2% or more, preferably 0.4% or more, and more preferably 0.5% or more. However, when the Mn content becomes excessive, quenchability is improved excessively, a supercooled structure is formed even after normalizing, and the machinability drops. Accordingly, the Mn amount should be 1.8% or less, preferably 1.5% or less, and more preferably 1% or less.

Al is a necessary element for improving the machinability in interrupted cutting by existing in a solid-solution state in the steel. Also, AlN precipitated by combining with N contributes to suppressing abnormal growth of grains during the carburizing treatment and during the carbonitriding treatment performed after the cutting work into the shape of the component, and to prevent deterioration of the impact performance due to drop of the toughness. Also, Al is an element having a deoxidizing action, and is a necessary element for improving the internal quality. Accordingly, in the present invention, Al is contained by 0.1% or more, preferably 0.13% or more. However, when Al is contained excessively and AlN is precipitated much, the machinability in continuous cutting deteriorates. Also, excessive AlN drops the hot workability in working into the shape of the component. Accordingly, the Al amount should be 0.5% or less, preferably 0.4% or less, and more preferably 0.35% or less.

B is an element combining with N and precipitating BN in the steel and contributing to improving both of the machinability in interrupted cutting and the machinability in continuous cutting. Also, because the solid-resolved N amount can be adjusted to the lesser direction by precipitating BN, the hot workability in working into the shape of the component can also be improved. Furthermore, B is an element improving the quenchability and enhancing the grain boundary strength in performing the heat treatment such as quenching and tempering after the cutting work, and contributing to improvement of the strength of the machine structural component. Accordingly, the B amount should be contained by 0.0005% or more, preferably 0.0007% or more, and more preferably 0.0010% or more. However, when B is contained excessively, the machinability drops because the hardness increases too high. Accordingly, the B amount should be 0.008% or less, preferably 0.006% or less, and more preferably 0.0035% or less.

N is an element combining with B and precipitating BN in the steel and contributing to improving the machinability in interrupted cutting and in continuous cutting as described above. Also, N is an element combining with Al and precipitating AlN in the steel and contributing to preventing abnormal growth of grains during the carburizing treatment and during the carbonitriding treatment performed after the cutting work into the shape of the component, and acts to improve the impact performance because deterioration of the toughness is suppressed. In order to exert such actions, the N amount should be 0.002% or more, preferably 0.003% or more, and more preferably 0.004% or more. However, when N is contained excessively and MN is precipitated too much, the machinability in continuous cutting deteriorates. Also, the hot workability drops when the precipitated amount of MN increases. Accordingly, the N amount should be 0.015% or less, preferably 0.010% or less, and more preferably 0.008% or less.

P is an unavoidably included impurity element and promotes generation of cracking in hot working, and therefore P is to be reduced as much as possible. Accordingly, in the present invention, the P amount should be 0.03% or less, preferably 0.02% or less, and more preferably 0.015% or less. Also, it is industrially difficult to make the P amount 0%.

S has an action of forming MnS-based inclusions when Mn is present in the steel and improving the machinability. However, when MnS-based inclusions are contained excessively, the ductility and toughness drop. Because the MnS-based inclusions are liable to extend in the rolling direction in rolling, they deteriorate the toughness particularly in the direction orthogonal to the rolling direction (transverse toughness). Accordingly, the S amount should be 0.03% or less, preferably 0.02% or less. Also, because S is an unavoidably included impurity element, it is industrially difficult to make the S amount 0%.

O is an unavoidably included impurity element, and is an element forming the coarse oxide-based inclusions and exerting adverse effects on the machinability, ductility, toughness, hot workability and the like. Accordingly, the O amount should be 0.002% or less, preferably 0.0015% or less. Further, it is also industrially difficult to make the O amount 0%.

The steel for machine structural use of the present invention satisfies the componential composition described above, and the remainder is iron and unavoidable impurities.

The steel for machine structural use of the present invention may further contain as other elements:

(a) Cr: 3% or less (excluding 0%), (b) Mo: 1% or less (excluding 0%), (c) Nb: 0.15% or less (excluding 0%), (d) at least one element selected from a group consisting of Zr: 0.02% or less (excluding 0%), Hf: 0.02% or less (excluding 0%), Ta: 0.02% or less (excluding 0%), and Ti: 0.02% or less (excluding 0%), (e) at least one element selected from a group consisting of V: 0.5% or less (excluding 0%), Cu: 3% or less (excluding 0%), and Ni: 3% or less (excluding 0%), and the like.

(a) Cr is an element improving the quenchability and enhancing the strength. Further, it is an element acting also in improving the machinability in interrupted cutting by adding jointly with Al. In order to exert such effects, Cr is preferable to be contained by 0.1% or more, more preferably 0.3% or more, and further more preferably 0.7% or more. However, when Cr is contained excessively, coarse carbides are formed and a supercooled structure is formed, and the machinability is deteriorated. Accordingly, it is preferable that the Cr amount is 3% or less, more preferably 2% or less, and further more preferably 1.6% or less.

(b) Mo is an element improving the quenchability and suppressing a slack-quenched structure to grow. Although such effects increase as the Mo content increases, Mo is preferable to be contained by 0.01% or more, more preferably 0.05% or more, and further more preferably 0.1% or more. However, when Mo is contained excessively, a supercooled structure is formed even after normalizing and the machinability deteriorates. Accordingly, the Mo amount is preferable to be 1% or less, more preferably 0.8% or less, and further more preferably 0.5% or less.

Nb combines with C and N and forms carbides, nitrides, and carbonitrides, and these compounds act to suppress grains to grow abnormally when the carburizing treatment or the carbonitriding treatment are performed after the cutting work into the shape of the component, and the impact performance improves. Although such effects increase as the Nb amount increases, in order to exert the effects effectively, it is preferable to contain Nb by 0.05% or more. However, when Nb is contained excessively, hard carbides, nitrides and the like precipitate excessively, and the machinability deteriorates. Accordingly, the Nb amount is preferable to be 0.15% or less, more preferably 0.13% or less.

(d) Similar to Nb described above, Zr, Hf, Ta and Ti are elements suppressing grains to grow abnormally, and contribute to improvement of the impact performance. Although these effects increase as the content of these elements increases, in order to exert these effects effectively, it is preferable to contain each element individually by 0.002% or more, more preferably 0.005% or more. However, when they are contained excessively, hard carbides, nitrides and the like precipitate much, and the machinability deteriorates. Accordingly, each element is preferable to be contained individually by 0.02% or less, more preferably 0.015% or less. Two elements or more optionally selected out of Zr, Hf, Ta and Ti may be contained. When two elements or more are to be contained, the total amount is preferable to be 0.02% or less, more preferably 0.015% or less.

(e) V, Cu and Ni are elements effectively acting in improving the quenchability and enhancing the strength. Although these effects are enhanced as the content of these elements increases, in order to exert these effects effectively, it is preferable to contain V by 0.05% or more, Cu by 0.1% or more, and Ni by 0.3 or more. However, when they are contained excessively, a supercooled structure is formed and the ductility and toughness drop, and therefore it is preferable to contain V by 0.5% or less, Cu by 3% or less, and Ni by 3% or less, more preferably V by 0.3% or less, Cu by 2% or less, and Ni by 2% or less.

In the present invention, in addition to that the chemical componential composition of the steel for machine structural use is adjusted to the stipulated range, it is important that the mass ratio of BN and AlN (BN/AlN) precipitated in the steel is 0.020-0.2.

That is, in the present invention, the machinability in interrupted cutting is improved by containing Al comparatively much in the range of 0.1-0.5% and allowing Al to be present in a solid-solution state in the steel. However, when Al is contained much, although the solid-resolved Al amount increases, a part of Al combines with N in the steel to precipitate AlN, and the AlN promotes wear of tools such as lathing tools, drills and the like and shortens the tool life. Because MN is a hard particle, it promotes wear of the tools and deteriorates the tool life (machinability) in continuous cutting in particular.

Accordingly, in the present invention, N and B in the steel are positively combined with each other, and BN is precipitated in the steel, thereby precipitation of AlN is suppressed, and the mass ratio of BN and MN (BN/AlN) precipitated in the steel is made 0.020-0.2. By making the BN/AlN ratio 0.020-0.2, both of the machinability in interrupted cutting and the machinability in continuous cutting can be improved, and the impact performance after the heat treatment can also be improved.

When BN/AlN is below 0.020, it means that MN is precipitated more than BN, and therefore the machinability in continuous cutting deteriorates. Accordingly, BN/AlN is to be made 0.020 or more, preferably 0.025 or more, and further more preferably 0.030 or more.

With respect to BN/AlN, a larger value is preferable, however when AlN is too low and BN/AlN exceeds 0.2, the impact performance after the heat treatment deteriorates. Accordingly, BN/AlN is to be made 0.2 or less, preferably 0.15 or less, more preferably 0.1 or less, and further more preferably 0.08 or less.

BN precipitated in the steel can be quantified by combining electrolytic extraction, acid dissolution, and the absorptiometric method for example. On the other hand, AlN precipitated in the steel can be quantified by the bromine-methyl acetate method for example.

It is preferable that the number ratio of BN precipitated on old austenitic grain boundaries to BN precipitated inside old austenitic grains out of BN precipitated in the steel (grain boundary BN/intra-grain BN) is 0.50 or less. By reducing the number of BN precipitated on the old austenitic grain boundaries (may be hereinafter denoted as "old γ") and increasing the number of BN precipitated inside the old γ grains, even when the heat treatment such as quenching and tempering is performed after the cutting work into the shape of the component in particular, the impact performance does not deteriorate, but the impact performance can be improved further more. Grain boundary BN/intra-grain BN is more preferable to be 0.45 or less, and is further more preferable to be 0.40 or less. Also, the lower limit value of grain boundary BN/intra-grain BN is approximately 0.30.

The number of BN precipitated on the old γ grain boundaries and the number of BN precipitated inside the old γ grains can be measured by analyzing the existing position and the componential composition using an energy dispersive X-ray spectrometer (EDS) attached to a scanning electron microscope (SEM).

Next, a manufacturing method for the steel for machine structural use in relation with the present invention will be described.

The steel for machine structural use in relation with the present invention can be manufactured by heating the steel satisfying the componential composition described above to 1,100° C. or above, thereafter holding the steel for 150 seconds or more at the temperature range of 900-1,050° C., and making the average cooling rate from 900° C. to 700° C. 0.05-10° C./sec. in cooling thereafter. Also, when the steel satisfying the componential composition described above is heated to 1,100° C. or above, is hot worked thereafter at 1,000° C. or above, and the holding time in the temperature range of 900-1,050° C. is made 150 seconds or more, BN can be positively precipitated inside the old γ grains in the cooling step thereafter, which is therefore more preferable. The reason such a range was stipulated will be described.

[Heating to 1,100° C. or Above]

It is necessary to heat the steel satisfying the componential composition described above once to 1,100° C. or above and to make the precipitates such as MN, BN and the like included in the steel be solid-resolved again. That is, the steel containing Al by 0.1% or more greatly varies with respect to a solid-solution state and a precipitation state of Al, B, and N according to its manufacturing condition, and therefore, in the present invention, MN and BN included in the steel are solid-resolved again in the steel by heating the steel to 1,100° C. or above.

[Holding for 150 Seconds or more in the Temperature Range of 900-1,050° C.]

After the steel is heated to 1,100° C. or above, by holding the steel for 150 seconds or more in the temperature range of 900-1,050° C., BN can be precipitated. That is, because the precipitation temperature of MN is below approximately 900° C. and the precipitation temperature of BN is approximately 1,050° C. or below, by holding the steel in the temperature range of 900-1,050° C., BN can be selectively precipitated.

However, when the holding time is less than 150 s, precipitation of BN does not progress sufficiently, BN becomes of shortage, and the machinability in continuous cutting cannot be improved. Further, the impact performance after the heat treatment also deteriorates. Accordingly, the holding time is to be 150 seconds or more, preferably 170 seconds or more, and more preferably 200 seconds or more. Although the upper limit of the holding time is not limited particularly, even when the steel is held for a long time, the precipitation amount of BN saturates and the productivity deteriorates, and therefore it can be 600 seconds or less for example.

The steel may be held at a constant temperature in the temperature range of 900-1,050° C., or otherwise the steel may be heated and/or cooled within the temperature range, and all that is required is that the holding time in the temperature range is 150 seconds or more.

[Average Cooling Rate from 900° C. to 700° C. is 0.05-10° C./sec.]

After the steel is held at 900-1,050° C. and BN is precipitated, by shortening the time for passing the temperature range of 900-700° C., precipitation of AlN is suppressed, BN is prevented from changing to AlN, and the precipitation amount of BN can be secured. That is, in the temperature range of 900-700° C., AlN is more stable thermodynamically than BN, therefore even when BN is selectively precipitated in the high temperature range of 900-1,050° C., if the time for passing the low temperature range of 900-700° C. becomes long, BN changes to AlN, and the precipitation amount of BN decreases. Therefore the BN/AlN ratio cannot be controlled to the range described above. Accordingly, in the present invention, the average cooling rate in cooling in the low temperature range from 900° C. to 700° C. is to be 0.05° C./sec. or more, preferably 0.1° C./sec. or more, more preferably 0.5° C./sec. or more, and further more preferably 1° C./sec. or more. However, when the average cooling rate in the temperature range is too high, a supercooled structure such as martensite, bainite and the like is generated, and the machinability drops adversely. Accordingly, the average cooling rate from 900° C. to 700° C. is to be 10° C./sec. or less, preferably 9.5° C./sec. or less, more preferably 8° C./sec. or less, further more preferably 5° C./sec. or less, and specifically preferably 3° C./sec. or less.

[Hot Working at 1,000° C. or Above]

In the present invention, it is also possible to heat the steel satisfying the componential composition described above to 1,100° C. or above, to perform hot working thereafter at 1,000° C. or above, and to make the holding time in the temperature range of 900-1,050° C. 150 seconds or more. By heating the steel to 1,100° C. or above to solid-resolve MN and BN again and performing hot working thereafter at 1,000° C. or above, the working strain can be introduced into the steel, the working strain becomes a precipitation point for BN, and BN comes to be more easily precipitated inside the γ grains than on the γ grain boundaries in the cooling step thereafter. As a result, BN can be precipitated inside the old γ grains, and the impact performance after performing the heat treatment such as quenching and tempering can be improved further more. It is more preferable that the hot working is performed at 1,050° C. or above. The upper limit of the hot working temperature only has to be lower than the heating temperature. Hot working may be hot forging for example.

Also, when the hot working is performed in the temperature range of 1,000-1,050° C., the total of the time for performing the hot working and the time to be held in the temperature range of 900-1,050° C. described above is to be made the holding time described above.

The steel for machine structural use in relation with the present invention obtained thus exerts excellent machinability (extending the tool life in particular) in both of interrupted cutting at a low speed and continuous cutting at a high speed because the balance of BN and AlN is properly controlled.

Also, because the balance of BN and MN of the steel for machine structural use of the present invention is properly controlled, the machine structural component obtained by cutting the steel for machine structural use into the shape of the component and thereafter performing the heat treatment such as quenching and tempering becomes excellent in the impact performance.

The heat treatment condition may be a condition usually adopted in manufacturing the machine structural components. For example, quenching may be performed after heating to approximately 800-1,000° C., and tempering may be performed then by holding the component approximately 20 min-1 hour at approximately 150-600° C.

Before performing the heat treatment such as quenching and tempering after the cutting work into the shape of the component, the carburizing treatment or the carbonitriding treatment can also be performed according to a normal method. Then, the carburizing treatment or the carbonitriding treatment can be performed in the temperature range of 900-1,050° C. for example. After the carburizing treatment or the carbonitriding treatment is performed, the heat treatment such as quenching and tempering can be performed continuously according to the condition described above.

Next, the case hardened steel component of the present invention will be described.

The present inventors have repeatedly done research from various aspects in order to improve the fatigue property (pitting resistance in particular) of the case hardened steel component obtained by carburizing or carbonitriding. As a result, it was found out that the fatigue property of the case hardened steel component could be improved when the condition of the carburizing treatment or the carbonitriding treatment was adjusted while properly adjusting the chemical componential composition of the steel and the mass ratio of BN and AlN (BN/AlN) precipitated on the surface of the component was suppressed to 0.01 or less, and the present invention was completed.

Further, the present inventors also made clear that, in manufacturing such a case hardened steel component, when the steel for machine structural use of the present invention described above was used, excellent machinability (tool life in particular) could be exerted in both of interrupted cutting at a low speed and continuous cutting at a high speed in the cutting work step, and the case hardened steel component of the present invention could be manufactured efficiently.

Below, the mass ratio of BN and MN featuring the case hardened steel component of the present invention will be described.

Also, with respect to the chemical componential composition of the case hardened steel component in relation with the present invention, the range thereof is common with that of the steel for machine structural use in relation with the present invention described above and the reason for limiting the component is duplicated, and therefore description will be omitted.

In the present invention, in addition to that the chemical componential composition of the case hardened steel component is adjusted to the stipulated range described above, it is important that the mass ratio of BN and AlN (BN/AlN) precipitated on the surface of the component is 0.01 or less.

That is, in the present invention, although B is contained in the range of 0.0005-0.008%, because BN precipitated by combination of B and N is liable to be coarsened, when coarse BN precipitates on the surface of the case hardened steel component, the coarse BN becomes an origin of fatigue failure and surface exfoliation is caused which becomes a cause of drop of the pitting resistance (fatigue property). Also, when BN precipitates much, the solid-resolved B amount in the steel decreases, and therefore the quechability drops which results in drop of the strength of the case hardened steel component.

Accordingly, in the present invention, N in the steel is positively combined with Al to precipitate MN, thereby precipitation of BN is suppressed, and the mass ratio of BN and MN (BN/AlN) precipitated on the surface of the component is made 0.01 or less, preferably 0.0080 or less, more preferably 0.0070 or less, and further more preferably 0.0060 or less. It is preferable that the lower limit of BN/AlN is approximately 0.0040.

BN precipitated on the surface of the component can be quantified by combining electrolytic extraction, acid dissolution, and the absorptiometric method for example. On the other hand, MN precipitated on the surface of the component can be quantified by the bromine-methyl acetate method for example.

In the present invention, the surface of the component means a region from the utmost surface of the component to the 1 mm depth position. Therefore, the BN amount and the MN amount of the surface of the component can be quantified by the method described above with respect to what is taken by scraping the portion from the surface of the component to the 1 mm depth position by cutting work.

Also, in the steel for machine structural use of the present invention described above, the mass ratio of (added) BN and MN (BN/AlN) in the steel was made 0.020-0.2. As described above, the reason of doing so is that improvement of the cutting workability is the main purpose, and on the other hand, in the case hardened steel component of the present invention, the mass ratio of (added) BN and AlN (BN/AlN) on the surface is made 0.01 or less with the aim of improving the fatigue property as a component. That is, the states entirely opposite to each other are stipulated in the middle of the progress of manufacturing the component in order to satisfy the requirement of the aspect of two different properties that, although it is important to precipitate BN comparatively much from a viewpoint of working in the stage prior to the cutting work into a component, when used as an actual component (after the cutting work is finished), it is important to reduce BN from the viewpoint of the property of the component.

The point which becomes important in order to make the steel, that is in entirely opposite state (the state BN is much) in the stage prior to working as described above, the state with less BN in the state of the component after the work is the manufacturing condition described below.

The case hardened steel component of the present invention can be manufactured by cutting the steel satisfying the componential composition described above into the shape of the component, thereafter being subjected to the carburizing treatment or the carbonitriding treatment, and making the average cooling rate from 900° C. to 800° C. 0.10° C./sec. or less (excluding 0° C./sec.) in cooling thereafter.

That is, although the precipitation temperature of AlN is approximately 750-900° C. and the precipitation temperature of BN is approximately 600-1,050° C., AlN is more stable thermodynamically than BN in the temperature range of 800-900° C., therefore by extending the time for passing the temperature range, BN precipitated in the steel can be changed to MN. As a result, because MN can be selectively precipitated without precipitating BN, the BN/AlN ratio can be controlled to 0.01 or less. Accordingly, in the present invention, the average cooling rate from 900° C. to 800° C. is to be made 0.10° C./sec. or less, preferably 0.08° C./sec. or less, and more preferably 0.05° C./sec. or less.

In cooling from 900° C. to 800° C., cooling may be performed at a constant rate from 900° C. toward 800° C., or otherwise the cooling rate may be changed in the middle. Also, the component may be cooled to a temperature below 800° C. after being held once in the temperature range of 900-800° C., and the average cooling rate from 900° C. to 800° C. only has to satisfy the range described above.

Although the carburizing treatment condition or carbonitriding treatment condition other than the average cooling rate is not particularly limited, it is preferable to make the temperature of carburizing (or carbonitriding) approximately 900-950° C. When the carburizing (or carbonitriding) temperature exceeds 950° C., AlN is liable to be solid-resolved, abnormal grain growth is caused, and the fatigue property may possibly drops. The holding time at the carburizing (or carbonitriding) temperature can be approximately 30 min-8 hours for example. Also, the atmosphere in heating to the carburizing (or carbonitriding) temperature can be carburizing (or carbonitriding) atmosphere.

The kind of carburizing or carbonitriding is not particularly limited, and a well-known method such as gas carburizing (gas carbonitriding), vacuum carburizing (vacuum carbonitriding), high content carburizing (high carbon carburizing), and the like can be adopted. The degree of vacuum in vacuum carburizing (vacuum carbonitriding) can be approximately 0.01 MPa or less for example.

After the carburizing or carbonitriding treatment, the quenching and tempering treatment can be performed according to a normal method with the exception that the average cooling rate from 900° C. to 800° C. is to be made 0.10° C./sec. or less.

The quenching and tempering condition can be a condition usually adopted in manufacturing the machine structural components, which is, for example, holding the component in the temperature range of approximately 800-850° C. after carburizing (or carbonitriding), performing quenching thereafter, then performing tempering by holding the component for approximately 20 min-1 hour at approximately 150-400° C. By adjusting the time for holding the component in the temperature range of approximately 800-850° C. after carburizing (or carbonitriding), the average cooling rate from 900° C. to 800° C. can be controlled to 0.10° C./sec. or less.

In the meantime, in manufacturing the case hardened steel component, as described above, when the steel for machine structural use in relation with the present invention is used, the machinability (tool life in particular) in the cutting work can also be improved.

More specifically, both of the machinability in interrupted cutting at a low speed and the machinability in continuous cutting at a high speed can be improved by performing the cutting work after the steel for machine structural use of the present invention, that is a steel for machine structural use reducing the AlN amount and increasing the BN amount in the steel, is manufactured by performing the heat treatment with the condition of heating the steel satisfying the componential composition described above to 1,100° C. or above, thereafter holding the steel for 150 seconds or more in the temperature range of 900-1,050° C., and making the average cooling rate from 900° C. to 700° C. 0.05-10° C./sec. in cooling thereafter as described in detail in a passage describing the manufacturing method for the steel for machine structural use of the present invention.

EXAMPLES

Although the present invention will be described below more specifically referring to examples, the present invention is not to be limited by the examples described below, it is a matter of course that the present invention can also be implemented with modifications added appropriately within the range adaptable to the purposes described previously and later, and any of them is to be included within the technical range of the present invention.

Example 1

Example in Relation with the Steel for Machine Structural use of the Present Invention 150 kg of steel of the chemical componential composition other than No. 18-22 shown in Table 1 below was molten by a vacuum induction furnace, was casted into an ingot of the top surface: Φ245 mm×bottom surface: Φ210 mm×length: 480 mm, was forged (soaking: 1,250° C.×3 hours approximately, forging heating: 1,100° C.×1 hour approximately), was cut, and was worked into two kinds of forged material of (a), (b) described below through a square material shape of 150 mm sides×680 mm length.

(a) Plate material: 30 mm thickness, 155 mm width, 100 mm length (b) Round bar material: Φ80 mm, 350 mm length

TABLE 1

| | Chemical composition (mass %) | | | | | | | | | | | |
|---|---|---|---|---|---|---|---|---|---|---|---|---|
| No. | C | Si | Mn | P | S | Al | B | N | O | Cr | Mo | Others |
| 1 | 0.06 | 0.21 | 0.80 | 0.01 | 0.01 | 0.21 | 0.0025 | 0.0048 | 0.0011 | 1.08 | — | |
| 2 | 0.19 | 0.19 | 0.81 | 0.01 | 0.01 | 0.23 | 0.0029 | 0.0052 | 0.0009 | 0.58 | — | |
| 3 | 0.48 | 0.36 | 0.49 | 0.01 | 0.01 | 0.18 | 0.0031 | 0.0046 | 0.0009 | 0.99 | — | |
| 4 | 0.21 | 0.92 | 0.77 | 0.01 | 0.01 | 0.21 | 0.0041 | 0.0054 | 0.0012 | 1.01 | — | |
| 5 | 0.20 | 0.21 | 0.80 | 0.01 | 0.01 | 0.15 | 0.0031 | 0.0144 | 0.0009 | — | — | |
| 6 | 0.20 | 0.18 | 0.81 | 0.01 | 0.01 | 0.22 | 0.0031 | 0.0051 | 0.0012 | 1.11 | 0.20 | |
| 7 | 0.18 | 0.24 | 0.72 | 0.01 | 0.01 | 0.11 | 0.0006 | 0.0021 | 0.0012 | 1.05 | 0.22 | |
| 8 | 0.20 | 0.22 | 0.80 | 0.01 | 0.01 | 0.16 | 0.0030 | 0.0052 | 0.0012 | 1.04 | 0.22 | V: 0.21 |
| 9 | 0.21 | 0.14 | 0.82 | 0.01 | 0.01 | 0.17 | 0.0033 | 0.0066 | 0.0011 | 1.03 | 0.19 | Cu: 0.29, Nb: 0.11 |
| 10 | 0.21 | 0.19 | 0.79 | 0.01 | 0.02 | 0.36 | 0.0009 | 0.0063 | 0.0010 | 1.10 | — | Zr: 0.01, Ni: 1.02 |
| 11 | 0.20 | 0.18 | 0.81 | 0.01 | 0.01 | 0.22 | 0.0031 | 0.0051 | 0.0012 | 1.11 | 0.20 | |
| 12 | 0.20 | 0.18 | 0.81 | 0.01 | 0.01 | 0.22 | 0.0031 | 0.0051 | 0.0012 | 1.11 | 0.20 | |
| 13 | 0.20 | 0.18 | 0.81 | 0.01 | 0.01 | 0.22 | 0.0031 | 0.0051 | 0.0012 | 1.11 | 0.20 | |
| 14 | 0.20 | 0.18 | 0.81 | 0.01 | 0.01 | 0.22 | 0.0031 | 0.0051 | 0.0012 | 1.11 | 0.20 | |
| 15 | 0.20 | 0.18 | 0.81 | 0.01 | 0.01 | 0.22 | 0.0031 | 0.0051 | 0.0012 | 1.11 | 0.20 | |
| 16 | 0.12 | 0.21 | 0.80 | 0.01 | 0.01 | 0.21 | 0.0025 | 0.0048 | 0.0011 | 1.08 | — | |
| 17 | 0.20 | 0.21 | 0.77 | 0.01 | 0.01 | 0.18 | 0.0049 | 0.0110 | 0.0010 | 1.01 | 0.21 | Ti: 0.012 |
| 18 | 0.48 | 0.36 | 0.49 | 0.01 | 0.01 | 0.18 | 0.0031 | 0.0046 | 0.0009 | 0.99 | — | |

TABLE 1-continued

| No. | Chemical composition (mass %) | | | | | | | | | | | |
|---|---|---|---|---|---|---|---|---|---|---|---|---|
| | C | Si | Mn | P | S | Al | B | N | O | Cr | Mo | Others |
| 19 | 0.20 | 0.18 | 0.81 | 0.01 | 0.01 | 0.22 | 0.0031 | 0.0051 | 0.0012 | 1.11 | 0.20 | |
| 20 | 0.18 | 0.24 | 0.72 | 0.01 | 0.01 | 0.11 | 0.0006 | 0.0021 | 0.0012 | 1.05 | 0.22 | |
| 21 | 0.20 | 0.22 | 0.80 | 0.01 | 0.01 | 0.16 | 0.0030 | 0.0052 | 0.0012 | 1.04 | 0.22 | V: 0.21 |
| 22 | 0.21 | 0.14 | 0.82 | 0.01 | 0.01 | 0.17 | 0.0033 | 0.0066 | 0.0011 | 1.03 | 0.19 | Cu: 0.29, Nb: 0.11 |
| 23 | 0.20 | 0.18 | 0.81 | 0.01 | 0.01 | 0.22 | 0.0031 | 0.0051 | 0.0012 | 1.11 | 0.20 | |
| 24 | 0.20 | 0.18 | 0.81 | 0.01 | 0.01 | 0.22 | 0.0031 | 0.0051 | 0.0012 | 1.11 | 0.20 | |
| 25 | 0.20 | 0.18 | 0.81 | 0.01 | 0.01 | 0.22 | 0.0031 | 0.0051 | 0.0012 | 1.11 | 0.20 | |
| 26 | 0.19 | 0.19 | 0.77 | 0.01 | 0.01 | 0.03 | 0.0031 | 0.0051 | 0.0012 | 1.06 | 0.19 | |
| 27 | 0.21 | 0.21 | 0.79 | 0.01 | 0.01 | 0.15 | 0.0003 | 0.0060 | 0.0010 | 1.05 | 0.18 | |
| 28 | 0.48 | 0.36 | 0.49 | 0.01 | 0.01 | 0.18 | 0.0031 | 0.0046 | 0.0009 | 0.99 | — | |

(a) Plate material and (b) round bar material obtained were heated, and were cooled thereafter. In cooling, the materials were held for a predetermined time at the temperature range of 900-1,050° C. Also, in cooling, the average cooling rate from 900° C. to 700° C. was varied. In Table 2 below, the heating temperature (° C.), the holding time (s) in the temperature range of 900-1,050° C., and the average cooling rate (° C./sec.) from 900° C. to 700° C. are shown respectively.

On the other hand, the steel with the chemical componential composition of No. 18-22 shown in Table 1 above was formed into a square material shape of 150 mm sides×680 mm length with the condition the same with that described above, was heated thereafter to 1,200° C., then was subjected to hot working to be forgingly extended from 150 mm square into Φ80 mm at 1,100° C., was thereafter worked into two kinds of forged material of (a), (b) above, and was cooled. In cooling, the materials were held for a predetermined time at the temperature range of 900-1,050° C. Also, in cooling, the average cooling rate from 900° C. to 700° C. was varied. In Table 2 below, the heating temperature (° C.), the holding time (s) in the temperature range of 900-1,050° C., and the average cooling rate (° C./sec.) from 900° C. to 700° C. are shown respectively.

BN and MN included in the round bar material after cooling were quantitatively analyzed, and the BN/AlN ratio was calculated by the mass ratio. Two samples taken from a same portion were prepared, and the BN amount and the AlN amount were quantified according to the procedure described below.

The BN amount included in the sample was quantified by combining electrolytic extraction, acid dissolution, and the absorptiometric method. More specifically, the sample was electrolyzed using AA-series electrolyte (methanol solution including 10 mass % acetylacetone and 1 mass % tetramethyl ammonium chloride), was filtered thereafter to obtain undissolved residues, and the residues were decomposed by hydrochloric acid and nitric acid and were thereafter heated and decomposed by adding sulfuric acid and phosphoric acid. Thereafter boron was distilled as methyl borate in accordance with JIS G 1227, and was absorbed by sodium hydroxide. The boron amount included in methyl borate that absorbed boron was quantified by the methyl borate distillation separation curcumin absorptiometric method in accordance with JIS G 1227. On the assumption that all amount of boron quantified generated BN, the N amount combined with the boron was calculated, and the sum of the boron amount quantified and the combined N amount calculated was made the BN amount.

Also, the AlN amount included in the sample was quantified by the bromine-methyl acetate method. More specifically, the sample was put in a flask, was heated to 70° C. in bromine and methyl acetate for melting, was thereafter filtered to obtain the undissolved residues, the residues were sufficiently washed by methyl acetate, and were thereafter dried. The residues dried were distilled by adding sodium hydroxide to an ammonia distiller in accordance with JIS G 1228, were absorbed by 0.1% boric acid as the absorbing liquid, the absorbing solution obtained was titrated by the amidosulfuric acid standard solution in accordance with JIS G 1228, and the AlN amount was quantified from the N amount in the absorbing liquid and the weighed amount of the sample.

Based on the quantified result, the BN/AlN ratio was calculated by the mass ratio. The calculation result is shown in Table 2 below.

Also, the portion around the position of 10 mm from the surface of the round bar material after cooling was observed using a scanning electron microscope (SEM), the componential composition of the precipitates observed within the observed field of view was analyzed using an energy dispersive X-ray spectrometer (EDS) attached to the SEM, the number of BN present on the old γ grain boundaries and the number of BN present inside the old γ grains were measured, and the number ratio of grain boundary BN/intra-grain BN was calculated. The number of BN was calculated averaging the results obtained by measuring 10 fields of view at 10,000 magnification with the detection limit of 0.1 μm in diameter. The result of calculation is shown in Table 2.

TABLE 2

| No. | Manufacturing condition | | | | BN/AlN | Grain boundary BN/intra-grain BN | Average flank wear amount of end mill (μm) | Average flank wear amount of lathing (μm) | Charpy impact value (J/cm$^2$) |
|---|---|---|---|---|---|---|---|---|---|
| | Heating temperature (° C.) | Hot working | Holding time (sec.) | Average cooling rate (° C./sec.) | | | | | |
| 1 | 1200 | Not performed | 180 | 2.0 | 0.031 | 0.54 | 60 | 61 | 72 |
| 2 | 1200 | Not performed | 180 | 2.0 | 0.033 | 0.59 | 53 | 71 | 60 |
| 3 | 1200 | Not performed | 180 | 2.0 | 0.025 | 0.56 | 57 | 79 | 50 |
| 4 | 1200 | Not performed | 180 | 2.0 | 0.034 | 0.53 | 52 | 62 | 65 |
| 5 | 1200 | Not performed | 180 | 2.0 | 0.041 | 0.61 | 49 | 69 | 54 |

TABLE 2-continued

| No. | Manufacturing condition: Heating temperature (° C.) | Hot working | Holding time (sec.) | Average cooling rate (° C./sec.) | BN/AlN | Grain boundary BN/intra-grain BN | Average flank wear amount of end mill (μm) | Average flank wear amount of lathing (μm) | Charpy impact value (J/cm$^2$) |
|---|---|---|---|---|---|---|---|---|---|
| 6 | 1200 | Not performed | 180 | 2.0 | 0.044 | 0.59 | 54 | 59 | 56 |
| 7 | 1200 | Not performed | 180 | 2.0 | 0.034 | 0.63 | 47 | 63 | 59 |
| 8 | 1200 | Not performed | 180 | 2.0 | 0.027 | 0.67 | 53 | 69 | 62 |
| 9 | 1200 | Not performed | 180 | 2.0 | 0.032 | 0.54 | 47 | 57 | 56 |
| 10 | 1200 | Not performed | 180 | 2.0 | 0.038 | 0.56 | 53 | 53 | 53 |
| 11 | 1110 | Not performed | 180 | 2.0 | 0.045 | 0.55 | 51 | 78 | 58 |
| 12 | 1200 | Not performed | 550 | 2.0 | 0.050 | 0.46 | 43 | 49 | 71 |
| 13 | 1200 | Not performed | 150 | 2.0 | 0.034 | 0.58 | 57 | 53 | 54 |
| 14 | 1200 | Not performed | 180 | 0.06 | 0.023 | 0.56 | 53 | 68 | 57 |
| 15 | 1200 | Not performed | 180 | 9.0 | 0.048 | 0.67 | 51 | 88 | 53 |
| 16 | 1200 | Not performed | 180 | 2.0 | 0.030 | 0.58 | 60 | 61 | 85 |
| 17 | 1200 | Not performed | 180 | 2.0 | 0.022 | 0.53 | 49 | 68 | 52 |
| 18 | 1200 | Performed | 180 | 2.0 | 0.033 | 0.43 | 48 | 61 | 56 |
| 19 | 1200 | Performed | 180 | 2.0 | 0.049 | 0.39 | 41 | 52 | 71 |
| 20 | 1200 | Performed | 180 | 2.0 | 0.044 | 0.35 | 40 | 50 | 73 |
| 21 | 1200 | Performed | 180 | 2.0 | 0.035 | 0.44 | 47 | 63 | 67 |
| 22 | 1200 | Performed | 180 | 2.0 | 0.038 | 0.37 | 61 | 49 | 68 |
| 23 | 1050 | Not performed | 180 | 2.0 | 0.015 | 0.62 | 49 | 106 | 41 |
| 24 | 1200 | Not performed | 120 | 2.0 | 0.016 | 0.66 | 63 | 116 | 46 |
| 25 | 1200 | Not performed | 180 | 0.03 | 0.018 | 0.63 | 57 | 106 | 44 |
| 26 | 1200 | Not performed | 180 | 2.0 | 0.053 | 0.58 | 107 | 68 | 53 |
| 27 | 1200 | Not performed | 180 | 2.0 | 0.007 | 0.61 | 56 | 104 | 43 |
| 28 | 1050 | Not performed | 180 | 2.0 | 0.014 | 0.65 | 85 | 129 | 42 |

Next, the machinability in interrupted cutting and the machinability in continuous cutting performed with the condition described below using the plate material and the round bar material after cooling were evaluated.

[Evaluation of Machinability in Interrupted Cutting (End Mill Cutting Test)]

In order to evaluate the machinability in interrupted cutting, the tool wear amount in end mill working was measured. In the end mill cutting test, the piece obtained by descaling the plate material and grinding the surface by approximately 2 mm was used as a specimen (material to be cut). More specifically, an end mill tool is attached to a spindle of a machining center, the specimen with 25 mm thickness×150 mm width×100 mm length manufactured as described above was fixed by a stock vice, and down cut work was performed under dry cutting atmosphere. Detailed working condition is shown in Table 3 below. After performing interrupted cutting by 200 cuts, the surface of the tool was observed at 100 magnification using an optical microscope, and the average flank wear amount (tool wear amount) Vb was measured. The result is shown in the Table 2. In the present invention, those with 80 μm or less of Vb after interrupted cutting were evaluated to be "excellent in machinability in interrupted cutting".

TABLE 3

| Interrupted cutting condition | |
|---|---|
| Cutting tool | |
| Type No. | High speed steel end mill K-2SL made by Mitsubishi Materials Corp. |
| Outside diameter | Ø 10.0 mm |
| Coating | TiAlN coating |
| Cutting condition | |
| Depth of cut in axial direction | 1.0 mm |
| Depth of cut in radial direction | 1.0 mm |
| Feed amount | 0.117 mm/rev |
| Feed speed | 558.9 mm/min |
| Cutting speed | 150 m/min |
| Number of revolution | 4777 rpm |

TABLE 3-continued

| Interrupted cutting condition | |
|---|---|
| Cutting atmosphere | Dry |
| Cutting length | 29 m |

[Evaluation of Machinability in Continuous Cutting (Lathe Cutting Test)]

In order to evaluate the machinability in continuous cutting, outer periphery lathe working was performed using the piece obtained by descaling the round bar material (D80 mm×350 mm length) and thereafter grinding the surface by approximately 2 mm as a lathe cutting test specimen (material to be cut). The condition of the outer periphery lathe working is as described below.

(Outer periphery lathe working condition)

Tool: Cemented carbide P10 (JIS B 4053)

Cutting speed: 200 m/min

Feed: 0.25 mm/rev

Depth of cut: 1.5 mm

Lubrication method: dry

After the outer periphery lathe working, the surface of the tool was observed at 100 magnification using an optical microscope, and the average flank wear amount (tool wear amount) Vb was measured. The result is shown in Table 2 above. In the present invention, those with 100 μm or less of Vb after continuous cutting were evaluated to be "excellent in machinability in continuous cutting", and those with 70 μm or less of Vb were evaluated to be "especially excellent in machinability in continuous cutting".

Next, the Charpy impact test was performed with the conditions described below using the round bar material after cooling, and the impact performance after the heat treatment was evaluated.

[Evaluation of Impact Characteristics]

In order to evaluate the impact performance after the cooling treatment, the piece obtained by cutting out a sample with 12 mm width×12 mm width×55 mm length from the round bar material after cooling and subjecting the heat treatment of heating to 850° C., thereafter quenching, then tempering for 30 min at 500° C., and cutting out thereafter a JIS No. 4 specimen with a U-notch was made a Charpy impact test specimen. The Charpy impact test was performed in accordance with JIS Z 2242 using the specimen. The result is shown in the Table 2.

From Table 2, following study is possible. No. 1-22 are examples satisfying the requirement stipulated in the present invention, exert excellent machinability (extending the tool life in particular) in both of interrupted cutting at a low speed and continuous cutting at a high speed and are excellent in impact performance even after quenching and tempering because the mass ratio of BN and AlN (BN/AlN) precipitated in the steel is adjusted to a proper range.

Particularly, No. 18-22 are examples of being subjected to heating to 1,200° C., hot forging thereafter at 1,100° C., and holding for a predetermined time at 900-1,050° C., and the chemical componential composition of these No. 18-22 are the same with that of No. 3, 6, 7, 8, 9 respectively. When comparing No. 3 with No. 18, No. 6 with No. 19, No. 7 with No. 20, No. 8 with No. 21, No. 9 with No. 22, by performing hot forging, grain boundary BN/intra-grain BN has been able to be controlled to 0.50 or less and the impact performance after the heat treatment has been able to be relatively improved compared with the case without hot forging.

On the contrary, in No. 23 and No. 28, the heating temperature is below 1,100° C., precipitation of BN is insufficient, the BN/AlN ratio is below 0.020, and therefore they are inferior in machinability in continuous cutting and impact performance after the heat treatment. In No. 24, the holding time in the temperature range of 900-1,050° C. is shorter than 150 s, precipitation of BN becomes insufficient, the BN/AlN ratio is below 0.020, and therefore it is inferior in the machinability in continuous cutting and the impact performance after the heat treatment. In No. 25, the average cooling rate in the temperature range from 900° C. to 700° C. is below 0.05° C./sec., MN is formed much, the BN/AlN ratio is below 0.020, and therefore it is inferior in machinability in continuous cutting and impact performance after the heat treatment. No. 26 is an example whose Al amount is less, the solid-resolved Al amount is of shortage, and therefore is inferior in machinability in interrupted cutting. No. 27 is an example whose B amount is less, precipitation of BN becomes insufficient, the BN/AlN ratio is below 0.020, and therefore it is inferior in machinability in continuous cutting and impact performance after the heat treatment.

Example 2

Example in Relation with the Case Hardened Steel Component of the Present Invention 150 kg of steel of the chemical componential composition shown in Table 4 below was molten by a vacuum induction furnace, was casted into an ingot of the top surface: Φ245 mm×bottom surface: Φ210 mm×length: 480 mm, was forged (soaking: 1,250° C.×3 hours approximately, forging heating: 1,100° C.×1 hour approximately), was cut, and was worked into two kinds of forged material of (a), (b) described below through a square material shape of 150 mm sides×680 mm length.

(a) Plate material: 30 mm thickness, 155 mm width, 100 mm length (b) Round bar material: Φ80 mm, 350 mm length

TABLE 4

| | Chemical composition (mass %) | | | | | | | | | | | |
|---|---|---|---|---|---|---|---|---|---|---|---|---|
| No. | C | Si | Mn | P | S | Al | B | N | O | Cr | Mo | Others |
| 1 | 0.12 | 0.21 | 0.80 | 0.012 | 0.013 | 0.21 | 0.0025 | 0.0048 | 0.0011 | 1.08 | — | |
| 2 | 0.19 | 0.19 | 0.81 | 0.011 | 0.013 | 0.23 | 0.0029 | 0.0052 | 0.0009 | 0.58 | — | |
| 3 | 0.48 | 0.36 | 0.49 | 0.009 | 0.011 | 0.18 | 0.0031 | 0.0046 | 0.0009 | 0.99 | — | |
| 4 | 0.21 | 0.92 | 0.77 | 0.013 | 0.013 | 0.21 | 0.0041 | 0.0054 | 0.0012 | 1.01 | — | |
| 5 | 0.20 | 0.21 | 0.80 | 0.013 | 0.011 | 0.15 | 0.0031 | 0.0144 | 0.0009 | — | — | |
| 6 | 0.20 | 0.18 | 0.81 | 0.012 | 0.011 | 0.22 | 0.0031 | 0.0051 | 0.0012 | 1.11 | 0.20 | |
| 7 | 0.18 | 0.24 | 0.72 | 0.012 | 0.013 | 0.11 | 0.0006 | 0.0021 | 0.0012 | 1.05 | 0.22 | |
| 8 | 0.20 | 0.21 | 0.77 | 0.011 | 0.013 | 0.18 | 0.0049 | 0.0110 | 0.0010 | 1.01 | 0.21 | Ti: 0.012 |
| 9 | 0.20 | 0.22 | 0.80 | 0.012 | 0.011 | 0.16 | 0.0030 | 0.0052 | 0.0012 | 1.04 | 0.22 | V: 0.21 |
| 10 | 0.21 | 0.14 | 0.82 | 0.012 | 0.011 | 0.17 | 0.0033 | 0.0066 | 0.0011 | 1.03 | 0.19 | Cu: 0.29, Nb: 0.11 |
| 11 | 0.21 | 0.19 | 0.79 | 0.012 | 0.015 | 0.36 | 0.0009 | 0.0063 | 0.0010 | 1.10 | — | Zr: 0.01, Ni: 1.02 |
| 12 | 0.20 | 0.18 | 0.81 | 0.012 | 0.011 | 0.22 | 0.0031 | 0.0051 | 0.0012 | 1.11 | 0.20 | |
| 13 | 0.20 | 0.18 | 0.81 | 0.012 | 0.011 | 0.22 | 0.0031 | 0.0051 | 0.0012 | 1.11 | 0.20 | |
| 14 | 0.20 | 0.18 | 0.81 | 0.012 | 0.011 | 0.22 | 0.0031 | 0.0051 | 0.0012 | 1.11 | 0.20 | |
| 15 | 0.20 | 0.18 | 0.81 | 0.012 | 0.011 | 0.22 | 0.0031 | 0.0051 | 0.0012 | 1.11 | 0.20 | |
| 16 | 0.20 | 0.18 | 0.81 | 0.012 | 0.011 | 0.22 | 0.0031 | 0.0051 | 0.0012 | 1.11 | 0.20 | |
| 17 | 0.20 | 0.18 | 0.81 | 0.012 | 0.011 | 0.22 | 0.0031 | 0.0051 | 0.0012 | 1.11 | 0.20 | |
| 18 | 0.20 | 0.18 | 0.81 | 0.012 | 0.011 | 0.22 | 0.0031 | 0.0051 | 0.0012 | 1.11 | 0.20 | |
| 19 | 0.19 | 0.19 | 0.77 | 0.011 | 0.011 | 0.22 | 0.0031 | 0.0051 | 0.0012 | 1.11 | 0.20 | |
| 20 | 0.19 | 0.19 | 0.77 | 0.011 | 0.011 | 0.03 | 0.0031 | 0.0051 | 0.0012 | 1.06 | 0.19 | |
| 21 | 0.21 | 0.21 | 0.79 | 0.014 | 0.013 | 0.15 | 0.0003 | 0.0060 | 0.0010 | 1.05 | 0.18 | |

(a) Plate material and (b) round bar material obtained were heated to a predetermined temperature, and were cooled thereafter. In cooling then, the materials were held for a predetermined time at the temperature range of 900-1,050° C. Also, after being held, the average cooling rate from 900° C. to 700° C. was varied. In Table 5 below, the heating temperature (° C.), the holding time (s) in the temperature range of 900-1,050° C., and the average cooling rate (° C./sec.) from 900° C. to 700° C. are shown respectively.

TABLE 5

| No. | Manufacturing condition: Heating temperature (° C.) | Hot working | Holding time (sec.) | Average cooling rate (° C./sec.) | Average flank wear amount of end mill (μm) | Average flank wear amount of lathing (μm) | Surface hardening treatment: Kind | Average cooling rate (° C./sec.) | BN/AlN | Life (×10000 times) |
|---|---|---|---|---|---|---|---|---|---|---|
| 1 | 1200 | Not performed | 180 | 2.0 | 60 | 61 | Gas carburizing | 0.05 | 0.0072 | 290 |
| 2 | 1200 | Not performed | 180 | 2.0 | 53 | 71 | Gas carburizing | 0.05 | 0.0048 | 323 |
| 3 | 1200 | Not performed | 180 | 2.0 | 57 | 79 | Gas carburizing | 0.05 | 0.0053 | 317 |
| 4 | 1200 | Not performed | 180 | 2.0 | 52 | 62 | Gas carburizing | 0.05 | 0.0058 | 268 |
| 5 | 1200 | Not performed | 180 | 2.0 | 49 | 69 | Gas carburizing | 0.05 | 0.0063 | 376 |
| 6 | 1200 | Not performed | 180 | 2.0 | 54 | 59 | Gas carburizing | 0.05 | 0.0082 | 307 |
| 7 | 1200 | Not performed | 180 | 2.0 | 47 | 63 | Gas carburizing | 0.05 | 0.0009 | 361 |
| 8 | 1200 | Not performed | 180 | 2.0 | 49 | 68 | Gas carburizing | 0.05 | 0.0009 | 332 |
| 9 | 1200 | Not performed | 180 | 2.0 | 53 | 69 | Gas carburizing | 0.05 | 0.0013 | 313 |
| 10 | 1200 | Not performed | 180 | 2.0 | 47 | 57 | High content carburizing | 0.05 | 0.0015 | 288 |
| 11 | 1200 | Not performed | 180 | 2.0 | 53 | 53 | Vacuum carburizing | 0.05 | 0.0066 | 455 |
| 12 | 1110 | Not performed | 180 | 2.0 | 51 | 78 | Carbonitriding | 0.05 | 0.0074 | 412 |
| 13 | 1200 | Not performed | 550 | 2.0 | 43 | 49 | Gas carburizing | 0.05 | 0.0089 | 405 |
| 14 | 1200 | Not performed | 150 | 2.0 | 57 | 53 | Gas carburizing | 0.05 | 0.0062 | 260 |
| 15 | 1200 | Not performed | 180 | 0.06 | 53 | 68 | Gas carburizing | 0.05 | 0.0067 | 278 |
| 16 | 1200 | Not performed | 180 | 9.0 | 51 | 88 | Gas carburizing | 0.01 | 0.0055 | 247 |
| 17 | 1050 | Not performed | 180 | 2.0 | 49 | 106 | Gas carburizing | 0.05 | 0.0072 | 342 |
| 18 | 1200 | Not performed | 120 | 2.0 | 63 | 116 | Gas carburizing | 0.05 | 0.0067 | 323 |
| 19 | 1200 | Not performed | 180 | 2.0 | 54 | 59 | Gas carburizing | 0.12 | 0.0240 | 108 |
| 20 | 1200 | Not performed | 180 | 2.0 | 107 | 68 | Gas carburizing | 0.05 | 0.0310 | 192 |
| 21 | 1200 | Not performed | 180 | 2.0 | 56 | 104 | Gas carburizing | 0.05 | 0.0011 | 163 |

The machinability in interrupted cutting and the machinability in continuous cutting performed with the condition described below using the plate material and the round bar material after cooling were evaluated.

[Evaluation of Machinability in Interrupted Cutting (End Mill Cutting Test)]

In order to evaluate the machinability in interrupted cutting, the tool wear amount in end mill working was measured. In the end mill cutting test, the piece obtained by descaling the plate material and grinding the surface by approximately 2 mm was used as a specimen (material to be cut). More specifically, an end mill tool is attached to a spindle of a machining center, the specimen with 25 mm thickness×150 mm width×100 mm length manufactured as described above was fixed by a stock vice, and down cut work was performed under dry cutting atmosphere. Detailed working condition is similar to that in the example 1, that is as per the Table 3. After performing interrupted cutting by 200 cuts, the surface of the tool was observed at 100 magnification using an optical microscope, and the average flank wear amount (tool wear amount) Vb was measured. The result is shown in the Table 5. In the present invention, those with 80 μm or less of Vb after interrupted cutting were evaluated to be "excellent in machinability in interrupted cutting".

[Evaluation of Machinability in Continuous Cutting (Lathe Cutting Test)]

In order to evaluate the machinability in continuous cutting, outer periphery lathe working was performed using the piece obtained by descaling the round bar material (Φ80 mm×350 mm length) and thereafter grinding the surface by approximately 2 mm as a lathe cutting test specimen (material to be cut). The condition of the outer periphery lathe working is as described below.

(Outer Periphery Lathe Working Condition)

Tool: Cemented carbide P10 (JIS B 4053)

Cutting speed: 200 m/min

Feed: 0.25 mm/rev

Depth of cut: 1.5 mm

Lubrication method: dry

After the outer periphery lathe working, the surface of the tool was observed at 100 magnification using an optical microscope, and the average flank wear amount (tool wear amount) Vb was measured. The result is shown in Table 5 above. In the present invention, those with 100 μm or less of Vb after continuous cutting were evaluated to be "excellent in machinability in continuous cutting", and those with 70 μm or less of Vb were evaluated to be "especially excellent in machinability in continuous cutting".

Figure 1B:
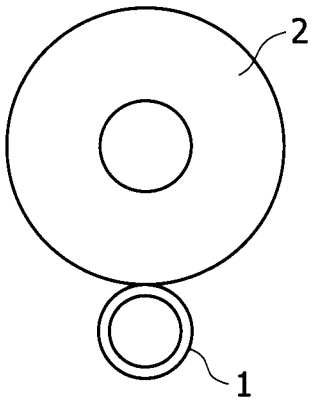

Next, the round bar material after cooling was subjected to cutting work into the shape of the specimen 1 shown in FIG. 1 (A), (B), was subjected thereafter to the carburizing treatment or the carbonitriding treatment, and the case hardened steel component was manufactured.

FIG. 1 (A), (B) are explanatory drawings showing a state of a specimen in performing a Komatsu type roller pitting test, (A) is an overall view, and (B) is a drawing when viewed from the arrow A direction of (A). In FIG. 1 (A), (B), 1 denotes the specimen, and 2 denotes its counterpart material. The specimen 1 is a small roller with 26 mm of the diameter of a part in contact with the counterpart material 2 and 28 mm of the width of the contact part. The counterpart material 2 is a large roller with 130 mm diameter and 8 mm width, and a crowning work of 150 mm radius is subjected in the width direction. The counterpart material 2 is obtained by quenching and tempering SUJ2 stipulated in JIS G 4805.

The specimen 1 obtained by the cutting work was subjected to the carburizing treatment or the carbonitriding treatment with the condition described below.

<Gas Carburizing>

The temperature of the specimen 1 obtained by the cutting work was raised to 930° C., the specimen 1 was held for 5 hours at the temperature for gas carburizing, was thereafter held for 10-90 min at 820° C., was then quenched by being put into the oil bath of 60° C., and was tempered for 30 min at 190° C. The average cooling rate from 900° C. to 800° C. after gas carburizing is shown in the Table 5. Also, the carbon potential in gas carburizing was made 0.85.

<High Content Carburizing (High Carbon Carburizing)>

The temperature of the specimen 1 obtained by the cutting work was raised to 945° C., the specimen 1 was held for 7 hours at the temperature for high content carburizing, was thereafter held for 30 min at 820° C., was then quenched by being put into the oil bath of 60° C., and was tempered for 30 min at 190° C. The average cooling rate from 900° C. to 800° C. after high content carburizing is shown in the Table 5. Also, the carbon potential in high content carburizing was made 1.2.

<Vacuum Carburizing>

The temperature of the specimen 1 obtained by the cutting work was raised to 930° C., the specimen 1 was held for 4 hours at the temperature for vacuum carburizing, was thereafter held for 30 min at 820° C., was then quenched by being put into the oil bath of 60° C., and was tempered for 30 min at 190° C. The average cooling rate from 900° C. to 800° C. after vacuum carburizing is shown in the Table 5. Also, the carbon potential in vacuum carburizing was made 0.85, and the pressure was made 0.005 MPa or less.

<Carbonitriding>

The temperature of the specimen 1 obtained by the cutting work was raised to 900° C., the specimen 1 was held for 5 hours at the temperature for carbonitriding, was thereafter held for 30 min at 820° C., was then quenched by being put into the oil bath of 60° C., and was tempered for 30 min at 190° C. The average cooling rate from 900° C. to 800° C. after carbonitriding is shown in the Table 5. Also, the carbon potential in carbonitriding was made 0.5.

The BN amount and the AlN amount precipitated on the surface of the case hardened steel component obtained were quantified with the condition described below, the Komatsu type roller pitting test was performed, the life of the case hardened steel component until exfoliation occurred was measured, and the fatigue property was evaluated.

[BN/AlN ratio]

The piece cut out by cutting the surface of the case hardened steel component (the region from the utmost surface to the position of 1 mm depth) was made a sample. Two samples taken from a same location were prepared, and the BN amount and the AlN amount included in the samples were quantified by a procedure described below.

The BN amount included in the sample was quantified by combining electrolytic extraction, acid dissolution, and the absorptiometric method. More specifically, the sample was electrolyzed by using AA-series electrolyte (methanol solution including 10 mass % acetylacetone and 1 mass % tetramethyl ammonium chloride), was filtered thereafter to obtain undissolved residues, and the residues were decomposed by hydrochloric acid and nitric acid and were thereafter heated and decomposed by adding sulfuric acid and phosphoric acid. Thereafter boron was distilled as methyl borate in accordance with JIS G 1227, and was absorbed by sodium hydroxide. The boron amount included in methyl borate that absorbed boron was quantified by the methyl borate distillation separation curcumin absorptiometric method in accordance with JIS G 1227. On the assumption that all amount of boron quantified generated BN, the N amount combined with the boron was calculated, and the sum of the boron amount quantified and the combined N amount calculated was made the BN amount.

Also, the AlN amount included in the sample was quantified by the bromine-methyl acetate method. More specifically, the sample was put in a flask, was heated to 70° C. in bromine and methyl acetate for melting, was thereafter filtered to obtain the undissolved residues, the residues were sufficiently washed by methyl acetate, and were thereafter dried. The residues dried were distilled by adding sodium hydroxide to an ammonia distiller in accordance with JIS G 1228, were absorbed to 0.1% boric acid as the absorbing liquid, the absorbing solution obtained was titrated by the amidosulfuric acid standard solution in accordance with JIS G 1228, and the AlN amount was quantified from the N amount in the absorbing liquid and the weighed amount of the sample.

Based on the quantified result, the BN/AlN ratio was calculated by the mass ratio. The calculation result is shown in the Table 5.

[Evaluation of Fatigue Property]

The fatigue property of the case hardened steel component was evaluated by executing the Komatsu type roller pitting test and measuring the life (number of times of rotation) until surface exfoliation occurred. The test condition was 2.5 GPa of the pressure of the contacted surface and −30% of the slide-roll ratio, an AT oil available on the market was used as a lubricant oil, presence/absence of exfoliation on the surface of the specimen was detected by a vibration sensor, the life (number of times of rotation of the specimen 1) until the surface exfoliation occurred was measured, and the fatigue property of the case hardened steel component was evaluated. The number of times of rotation of the specimen 1 until the surface exfoliation occurs is shown in the Table 5. In the present invention, the case in which the number of times of rotation was 2 million times or more was regarded to have passed, and was evaluated to be excellent in the fatigue property.

From the Table 5, following study is possible.

No. 1-18 are examples satisfying the requirement stipulated in the present invention, the mass ratio of BN and AlN (BN/AlN) precipitated on the surface of the component is adjusted to a proper range, therefore the surface fatigue strength improves, and they are excellent in the fatigue property (pitting resistance in particular). Particularly in No. 1-16, because the heat treatment condition before the cutting work is properly controlled, excellent machinability (extending the tool life in particular) is exerted in both of interrupted cutting at a low speed and continuous cutting at a high speed.

On the other hand, in No. 19, because the holding time at 820° C. before quenching was made as short as 10 min after gas carburizing, the average cooling rate from 900° C. to 800° C. exceeds 0.10° C./sec. and the BN/AlN ratio exceeds 0.01. Accordingly, the fatigue property of the case hardened steel component has not been able to be improved. No. 20 is an example in which the Al amount is less, and because the solid-resolved Al amount is of shortage, it is inferior in machinability in interrupted cutting. Also, because the Al amount is less, BN/AlN on the surface of the component becomes large exceeding 0.01, No. 20 is inferior in the fatigue property. No. 21 an example in which the B amount is less, and because the quenchability improvement effect by B is not exerted, the fatigue property is deteriorated. Also, it is inferior in machinability in continuous cutting.

Although the present invention has been described in detail and referring to specific embodiments, it is obvious for a person with an ordinary skill in the art that a variety of alterations and modifications can be added without departing from the spirit and scope of the present invention.

The present application is based on the Japanese Patent Application (No. 2009-230910) applied on Oct. 2, 2009 and the Japanese Patent Application (No. 2009-230911) applied on Oct. 2, 2009, and the content of them is herein incorporated as a reference.

INDUSTRIAL APPLICABILITY

The present invention can be applied for example to the machine structural components such as gears, shafts, pulleys, constant velocity universal joints and the like used for a variety of gear transmission devices to begin with a transmission and a differential gear for an automobile, as well as crank shafts, con'rods and the like.

The invention claimed is:

1. A steel, consisting essentially of, by mass percent based on a total mass of the steel:

C: 0.05-0.8%;
Si: 0.03-2%;
Mn: 0.2-1.8%;
Al: 0.1-0.5%;
B: 0.0005-0.008%;
N: 0.002-0.007%;
P: 0.03% or less, excluding 0%;
S: 0.03% or less, excluding 0%; and
O: 0.002% or less, excluding 0%;
with the remainder iron and unavoidable impurities,
wherein a mass ratio of BN to AlN (BN/AlN), precipitated in the steel, is in a range from 0.020-0.2, and
wherein a number ratio of BN precipitated on an old austenitic grain boundary to BN precipitated inside an old austenitic grain, (grain boundary BN/intra-grain BN), out of BN precipitated in the steel is 0.50 or less.

2. A steel, consisting essentially of, by mass percent based on a total mass of the steel:

C: 0.05-0.8%;
Si: 0.15-1.0%;
Cr: 0.7-1.6%;
Mn: 0.2-1.8%;
Al: 0.1-0.5%;
B: 0.0005-0.008%;
N: 0.002-0.007%;
P: 0.03% or less, excluding 0%;
S: 0.03% or less, excluding 0%; and
O: 0.002% or less, excluding 0%;
with the remainder iron and unavoidable impurities,
wherein a mass ratio of BN to AlN (BN/AlN), precipitated in the steel, is in a range from 0.020-0.2, and
wherein a number ratio of BN precipitated on an old austenitic grain boundary to BN precipitated inside an old austenitic grain, (grain boundary BN/intra-grain BN), out of BN precipitated in the steel is 0.50 or less.

3. A steel of claim 2, wherein the Si content is 0.15-0.6 mass %.

* * * * *